US006647742B1

(12) United States Patent
Neiter et al.

(10) Patent No.: US 6,647,742 B1
(45) Date of Patent: Nov. 18, 2003

(54) EXPANDER DRIVEN MOTOR FOR AUXILIARY MACHINERY

(75) Inventors: Jeff J. Neiter, Coventry, CT (US); Sivakumar Gopalnarayanan, Simsbury, CT (US); J. Michael Griffin, Fayetteville, NY (US); William A. Rioux, Willington, CT (US); Young K. Park, Manlius, NY (US); Russell G. Lewis, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/157,657

(22) Filed: May 29, 2002

(51) Int. Cl.[7] ..... F25B 1/00; F25D 9/00

(52) U.S. Cl. ..... 62/498; 62/116; 62/402; 62/115

(58) Field of Search ..... 62/116, 402, 115, 62/498

(56) References Cited

U.S. PATENT DOCUMENTS 4,170,116 A * 10/1979 Williams ..... 62/116
4,283,211 A * 8/1981 Ehrlich et al. ..... 62/4
4,362,462 A 12/1982 Blotenberg
4,498,306 A * 2/1985 Tyree, Jr. ..... 62/119
4,592,204 A 6/1986 Rice
4,660,511 A * 4/1987 Anderson ..... 122/420
5,259,198 A * 11/1993 Viegas et al. ..... 62/7
5,311,927 A * 5/1994 Taylor et al. ..... 165/64
5,647,221 A * 7/1997 Garris, Jr. ..... 62/116
5,730,216 A 3/1998 Viegas et al.
5,947,712 A 9/1999 Viegas et al.
6,298,677 B1 10/2001 Bujak et al.
6,378,313 B2 * 4/2002 Barrash ..... 62/6

FOREIGN PATENT DOCUMENTS

EP 0 908 688 A2 4/1999

* cited by examiner

*Primary Examiner*—William C. Doerrler
*Assistant Examiner*—Mark S. Shulman
(74) *Attorney, Agent, or Firm*—Carlson, Gaskey & Olds

(57) ABSTRACT

The expansion of a high pressure or intermediate pressure refrigerant in an expansion device in a transcritical vapor compression system converts the potential energy into usable kinetic energy. The kinetic energy provides work which is employed to fully or partially drive an expansion motor unit which is coupled to rotating auxiliary machinery. By providing work to the rotating auxiliary machinery, system efficiency is improved. The auxiliary rotating machinery can be an evaporator fan or a gas cooler fan to pull the refrigerant through the evaporator and gas cooler, respectively. Alternatively, the auxiliary rotating machinery can be a water pump or an oil pump.

14 Claims, 1 Drawing Sheet

EXPANDER DRIVEN MOTOR FOR AUXILIARY MACHINERY

BACKGROUND OF THE INVENTION

The present invention relates generally to a means for increasing the cycle performance of a vapor compression system by using the work produced by the expansion of high or intermediate pressure refrigerant to drive an expander motor coupled to auxiliary rotating machinery.

Chlorine containing refrigerants have been phased out in most of the world due to their ozone destroying potential. Hydrofluoro carbons (HFCs) have been used as replacement refrigerants, but these refrigerants still have high global warming potential. "Natural" refrigerants, such as carbon dioxide and propane, have been proposed as replacement fluids. Unfortunately, there are problems with the use of many of these fluids as well. Carbon dioxide has a low critical point, which causes most air conditioning systems utilizing carbon dioxide to run transcritical under most conditions.

When a typical vapor compression system runs transcritical, the high side pressure of the refrigerant is high enough that the refrigerant does not change phases from vapor to liquid while passing through the heat rejecting heat exchanger. Therefore, the heat rejecting heat exchanger operates as a gas cooler in a transcritical cycle rather than as a condenser. The pressure of a subcritical fluid is a function of temperature under saturated conditions (where both liquid and vapor are present).

In a transcritical vapor compression system, refrigerant is compressed to a high pressure in the compressor. As the refrigerant enters the gas cooler, heat is removed from the high pressure refrigerant. Next, after passing through an expansion device, the refrigerant is expanded to a low pressure. The refrigerant then passes through an evaporator and accepts heat, fully vaporizes, and re-enters the compressor completing the cycle.

In refrigeration systems, the expansion device is typically an orifice. It is possible to use an expander unit to extract the energy from the high pressure fluid. In this case, the expansion of the refrigerant flowing from the gas cooler or condenser and into the evaporator converts the potential energy in the high pressure refrigerant to kinetic energy, producing work. If the energy is not used to drive another component in the system, it is lost. In prior systems, the energy converted by the expansion of the refrigerant drives an expander motor unit coupled to the compressor to either fully or partially power the compressor. The expansion of pressurized cryogen has also been used in prior systems to drive mechanical devices in refrigerant units, but not in vapor compression systems.

SUMMARY OF THE INVENTION

A reversible vapor compression system includes a compressor, a first heat exchanger, an expansion device, an expansion motor unit coupled to auxiliary rotating machinery, a second heat exchanger, and a device to reverse the direction of refrigerant flow. By reversing the flow of the refrigerant with the heat pump, the vapor compression system can alternate between a heating mode and a cooling mode. Preferably, carbon dioxide is used as the refrigerant. Because carbon dioxide has a low critical point, systems utilizing carbon dioxide as a refrigerant usually require the vapor compression system to run transcritical.

The high pressure or intermediate pressure refrigerant exiting the gas cooler is high in potential energy. The expansion of the high pressure refrigerant in the expansion device converts the potential energy into useable kinetic energy which is utilized to completely or partially drive an expansion motor unit. The expansion motor unit is coupled to drive auxiliary machinery. By employing the kinetic energy converted by the expansion of the high pressure or intermediate pressure refrigerant to fully or partially drive the expansion motor unit coupled to the auxiliary machinery, system efficiency is improved. The auxiliary machinery can be an evaporator fan or a gas cooler fan which draw the air through the evaporator and gas cooler, respectively. Alternatively, the auxiliary machinery can be a water pump which pumps the water or other fluid through the evaporator or gas cooler that exchanges heat with the refrigerant. The auxiliary machinery can also be an oil pump used to lubricate the compressor.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
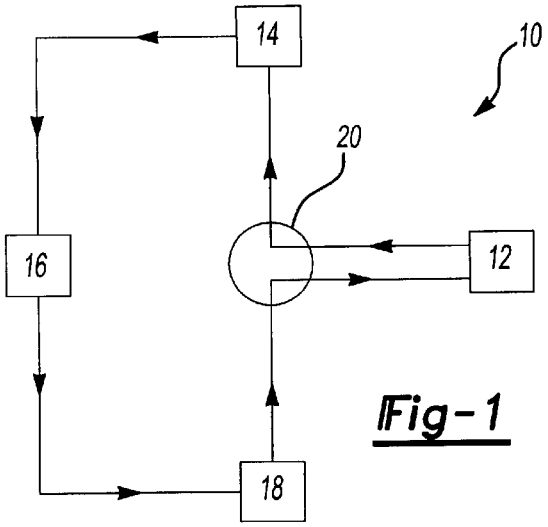
FIG. 1 illustrates a schematic diagram of a prior art vapor compression system.

FIG. 1 illustrates a schematic diagram of a prior art reversible vapor compression system 10. The system 10 includes a compressor 12, a first heat exchanger 14, an expansion device 16, a second heat exchanger 18, and a reversible heat pump 20. Refrigerant circulates though the closed circuit system 10, and the heat pump 20 changes the direction of refrigerant flow to switch the system between cooling mode and heating mode.

Figure 2:
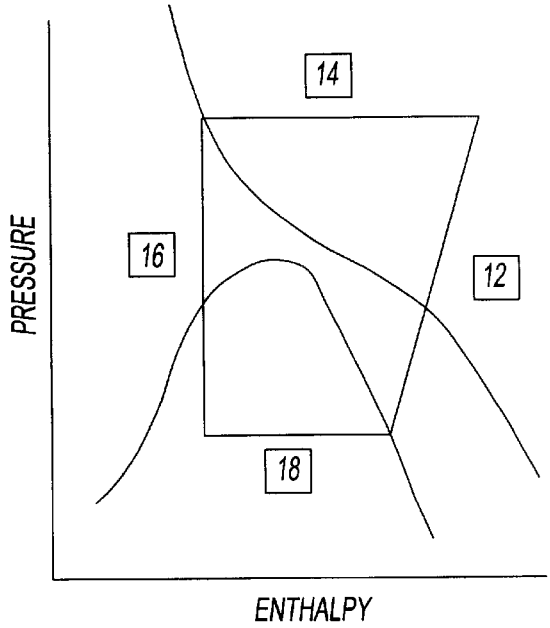
FIG. 2 illustrates a thermodynamic diagram of a transcritical vapor compression system.

As shown in FIG. 1, when operating in a cooling mode, after the refrigerant exits the compressor 12 at high pressure, the heat pump 20 directs the refrigerant into the first heat exchanger 14, which acts as a heat rejecting heat exchanger or a gas cooler. The refrigerant flows through the first heat exchanger 14 and loses heat, exiting the first heat exchanger 14 at low enthalpy and high pressure. As the refrigerant passes through the expansion device 16, the pressure drops. After expansion, the refrigerant flows through the second heat exchanger 18, which acts as a heat accepting heat exchanger or evaporator and exits at a high enthalpy and low pressure. The refrigerant then flows through the heat pump 20 and re-enters and passes through the compressor 12, completing the system 10. By reversing the direction of the flow of the refrigerant with the heat pump 20, the system 10 can operate in a heating mode. A thermodynamic diagram of the vapor compression system 10 is illustrated in FIG. 2.

In a preferred embodiment of the invention, carbon dioxide is used as the refrigerant. While carbon dioxide is illustrated, other refrigerants may benefit from this invention. Because carbon dioxide has a low critical point, systems utilizing carbon dioxide as a refrigerant usually require the vapor compression system 10 to run transcritical. Although a transcritical vapor compression system 10 is disclosed, it is to be understood that a conventional subcritical vapor compression cycle can be employed as well. Additionally, the present invention can also be applied to refrigeration cycles that operate at multiple pressure levels, such as systems having more than one compressors, gas cooler, expander motors, or evaporators.

Figure 3:
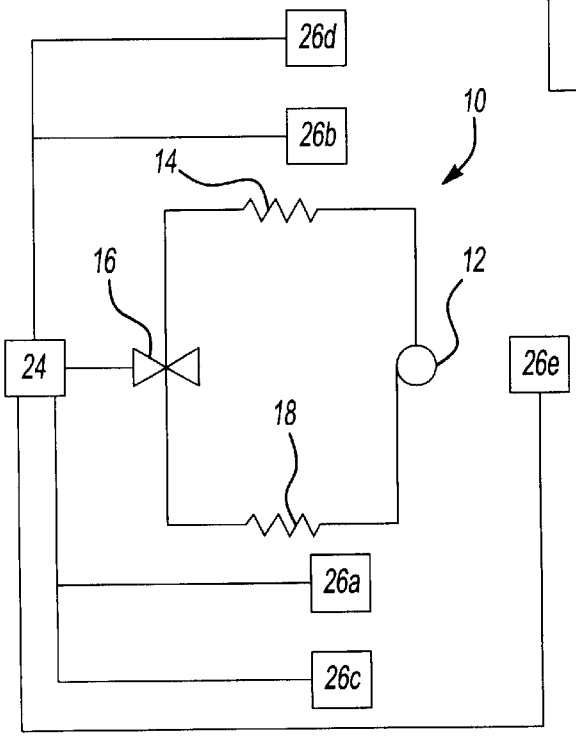
FIG. 3 illustrates a schematic diagram of auxiliary machinery coupled to the expansion motor.

The high pressure or intermediate pressure refrigerant exiting the gas cooler 14 is high in potential energy. The process of expansion of the high pressure refrigerant in the expansion device 16 to low pressure converts the potential energy into useable kinetic energy. As shown in FIG. 3, the kinetic energy provides work which is used to fully or partially drive an expander motor unit 24. The expander motor unit 24 is coupled to auxiliary machinery 26*a*–26*e*, and the work is provided to operate and reduce the power requirements of the auxiliary machinery. The structure, control and operation of the expansion device 16 and the drive connection to the auxiliary machinery is well within the level of ordinary skill. It is the use of the expansion device 16 to drive the auxiliary machinery which is inventive. By employing the kinetic energy converted by the expansion of the high pressure or intermediate pressure refrigerant to drive the expander motor unit 24 for the operation of the auxiliary rotating machinery 26, system efficiency is improved.

The auxiliary rotating machinery coupled to the expander motor unit 24 can be an evaporator fan 26*a* or a gas cooler fan 26*b*. The heat exchanger fans 26*a* and 26*b* draw the refrigerant through the evaporator 18 and the condenser 14, respectively, during operation of the system 10. The auxiliary machinery 26 can also be a water pump 26c or 26*d*. The water pumps 26*c* and 26*d* pump water through the gas cooler 14 and evaporator 18, respectively. The water exchanges heat with the refrigerant drawn through the gas cooler 14 and evaporator 18. Water pumped by the evaporator water pump 26*c* rejects heat which is accepted by refrigerant. Water pumped by the gas cooler water pump 26*d* accepts heat which is rejected by the refrigerant. The work produced by the expansion of the refrigerant can also be utilized to power an oil pump 26*e* which pumps oil through the compressor 12 to provide lubrication.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A vapor compression system comprising:

a compression device to compress a refrigerant to a high pressure;

a heat rejecting heat exchanger for cooling said refrigerant;

an expansion device for reducing said refrigerant to a low pressure;

a heat accepting heat exchanger for evaporating said refrigerant;

an auxiliary machinery coupled to said expansion device and powered by the expansion of said refrigerant from said high pressure to said low pressure; and a heat pump to reverse flow of said refrigerant.

2. The system as recited in claim 1 wherein said auxiliary machinery is a heat rejecting heat exchanger fan.

3. The system as recited in claim 1 wherein said auxiliary machinery is a heat accepting heat exchanger fan.

4. The system as recited in claim 1 further including an expansion motor, the expansion of said refrigerant powering said expansion motor to drive said auxiliary machinery.

5. The system as recited in claim 1 wherein said refrigerant is carbon dioxide.

6. A vapor compression system comprising:

a compression device to compress a refrigerant to a high pressure;

a heat rejecting heat exchanger for cooling said refrigerant;

an expansion device for reducing said refrigerant to a low pressure;

a heat accepting heat exchanger for evaporating said refrigerant;

a heat pump to reverse flow of said refrigerant;

an expansion motor powered by expansion of said refrigerant from said high pressure to said low pressure; and an auxiliary machinery driven by said expansion motor.

7. The system as recited in claim 6 wherein said auxiliary machinery is a heat rejecting heat exchanger fan.

8. The system as recited in claim 6 wherein said auxiliary machinery is a heat accepting heat exchanger fan.

9. The system as recited in claim 6 wherein said auxiliary machinery is a water pump.

10. The system as recited in claim 6 wherein said auxiliary machinery is an oil.

11. The system as recited in claim 6 wherein said refrigerant is carbon dioxide.

12. A vapor compression system comprising:

a compression device to compress a refrigerant to a high pressure;

a heat rejecting heat exchanger for cooling said refrigerant;

an expansion device for reducing said refrigerant to a low pressure;

a heat accepting heat exchanger for evaporating said refrigerant; and a water pump coupled to said expansion device and powered by the expansion of said refrigerant from said high pressure to said low pressure.

13. A vapor compression system comprising:

a compression device to compress a refrigerant to a high pressure;

a heat rejecting heat exchanger for cooling said refrigerant;

an expansion device for reducing said refrigerant to a low pressure;

a heat accepting heat exchanger for evaporating said refrigerant; and an oil pump coupled to said expansion device and powered by the expansion of said refrigerant from said high pressure to said low pressure.

14. A vapor compression system comprising:

a compression device to compress a refrigerant to a high pressure;

a heat rejecting heat exchanger for cooling said refrigerant;

an expansion device for reducing said refrigerant to a low pressure;

a heat accepting heat exchanger for evaporating said refrigerant;

an auxiliary machinery coupled to said expansion device and powered by the expansion of said refrigerant from said high pressure to said low pressure; and an additional compression device, an additional heal rejecting heat exchanger, an additional expansion device, and an additional heat accepting heat exchanger.

* * * * *

UNITED STATES PATENT AND TRADEMARK OFFICE

CERTIFICATE OF CORRECTION

PATENT NO. : 6,647,742 B1
DATED : November 18, 2003
INVENTOR(S) : Neiter et al.

It is certified that error appears in the above-identified patent and that said Letters Patent is hereby corrected as shown below:

Column 4,
Line 57, please insert -- pump -- after "oil" and before "."

Column 6,
Line 14, "heal" should be -- heat --

Signed and Sealed this

Twentieth Day of January, 2004

JON W. DUDAS
*Acting Director of the United States Patent and Trademark Office*